US008500237B2

(12) United States Patent
Sugiura

(10) Patent No.: US 8,500,237 B2
(45) Date of Patent: Aug. 6, 2013

(54) LIQUID EJECTING APPARATUS

(75) Inventor: Keita Sugiura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/433,030

(22) Filed: Mar. 28, 2012

(65) Prior Publication Data

US 2012/0306965 A1 Dec. 6, 2012

(30) Foreign Application Priority Data

May 30, 2011 (JP) ..... 2011-120008

(51) Int. Cl.
*B41J 2/165* (2006.01)

(52) U.S. Cl.
USPC ..... 347/29

(58) Field of Classification Search
None
See application file for complete search history.

(56) References Cited

U.S. PATENT DOCUMENTS 5,117,244 A * 5/1992 Yu ..... 347/29

FOREIGN PATENT DOCUMENTS

JP H09-085959 A 3/1997

* cited by examiner

*Primary Examiner* — Matthew Luu
*Assistant Examiner* — Justin Seo
(74) *Attorney, Agent, or Firm* — Baker Botts L.L.P.

(57) ABSTRACT

A liquid ejecting apparatus, including a head and a capping mechanism which includes: a surrounding member including a lip that surrounds the head and a diaphragm which closes a space between the lip and the head and which outwardly biases the lip; a guide fixed to the head; a holder which surrounds the head and to which the lip is fixed; a moving mechanism configured to move the guide and the holder relative to each other such that the capping mechanism is placed in one of a hermetically sealed state and a non-hermetically sealed state; and a restraining member which is provided on one of the holder and the guide and which is configured to restrain outward deformation of the lip by contacting the other of the holder and the guide, when the capping mechanism is placed in the hermetically sealed state.

10 Claims, 11 Drawing Sheets

LIQUID EJECTING APPARATUS

CROSS REFERENCE TO RELATED APPLICATION

The present application claims priority from Japanese Patent Application No. 2011-120008, which was filed on May 30, 2011, the disclosure of which is herein incorporated by reference in its entirety.

BACKGROUND OF THE INVENTION

1. Field of the Invention

The present invention relates to a liquid ejecting apparatus configured to eject a liquid from ejection openings.

2. Discussion of Related Art

There is known an ink-jet recording apparatus configured such that a capping member provided around a recording head is brought into close contact with a conveyor belt, whereby a nozzle surface of the recording head is capped by the capping member and the conveyor belt. In the ink-jet recording apparatus, the capping member includes a side plate surrounding the recording head and a sheet whose outer peripheral end is fixed to an upper end of the side plate and inner peripheral end is fixed to an outer surface of the recording head.

SUMMARY OF THE INVENTION

In the capping member described above, a lower end portion of the side plate is formed of an elastic member. To reduce the cost of the capping member, it may be considered that an elastic diaphragm having a function of the sheet is formed integrally with the elastic member. In this instance, in terms of accommodation of manufacturing errors, the diaphragm is formed to have a length from its outer peripheral end to its inner peripheral end which is slightly longer than a linear distance between the outer peripheral end and the inner peripheral end in a state in which the nozzle surface is capped by the capping member. Accordingly, the diaphragm is configured to outwardly bias the side plate (including the elastic member) even in the capping state. When the diaphragm thus biases the elastic member outwardly, the side plate per se, the longitudinally central portion of the side plate, in particular, tends to deform outwardly. The degree of deformation differs depending upon portions of the side plate, and the contact state of the elastic member with respect to the conveyor belt also differs depending upon portions of the elastic member. Where the degree of deformation is large, hermeticity in the capping state is reduced, as compared with an instance where the degree of deformation is low or no deformation exists. To ensure the hermeticity in the capping state, it is needed to increase a contact force, undesirably resulting in an increase of the size of the apparatus and a complicated structure of the apparatus.

It is therefore an object of the present invention to provide a liquid ejecting apparatus capable of ensuring a high degree of hermeticity in a hermetically sealed state.

The above-indicated object of the present invention may be attained according to a principle of the invention, which provides, a liquid ejecting apparatus, comprising:

a liquid ejecting head in which are formed ejection openings through which a liquid is ejected; and a capping mechanism configured to be selectively placed between: a hermetically sealed state in which an ejection space that is opposed to the ejection openings is isolated from an external space; and a non-hermetically sealed state in which the ejection space is open to the external space, wherein the capping mechanism includes:

a surrounding member having elasticity and integrally including (a) a lip which surrounds the liquid ejecting head and (b) a diaphragm which closes a space between the lip and the liquid ejecting head and which outwardly biases the lip;

a guide fixed to the liquid ejecting head so as to have a certain positional relationship with respect to the liquid ejecting head;

a holder which surrounds the liquid ejecting head and to which the lip is fixed;

a moving mechanism configured to move the guide and the holder relative to each other such that the capping mechanism is placed in one of: the hermetically sealed state in which the lip is located at an abutting position where the lip is in abutting contact with an opposing member opposed to the ejection openings with the ejection space interposed therebetween; and the non-hermetically sealed state in which the lip is located at a separate position where the lip is separated away from the opposing member; and a restraining member which is provided on one of the holder and the guide and which is configured to restrain outward deformation of the lip by contacting the other of the holder and the guide, when the capping mechanism is placed in the hermetically sealed state.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which:

FIGS. 10A and 10B are views showing a liquid ejecting apparatus according to a second modified embodiment of the present invention, FIG. 10A being a view for explaining a hermetically sealed state established by a capping mechanism while FIG. 10B shows a roller member in plan view and the guide in cross section.

DETAILED DESCRIPTION OF THE EMBODIMENTS

Hereinafter, there will be explained one embodiment of the present invention with reference to the drawings.

Figure 1:
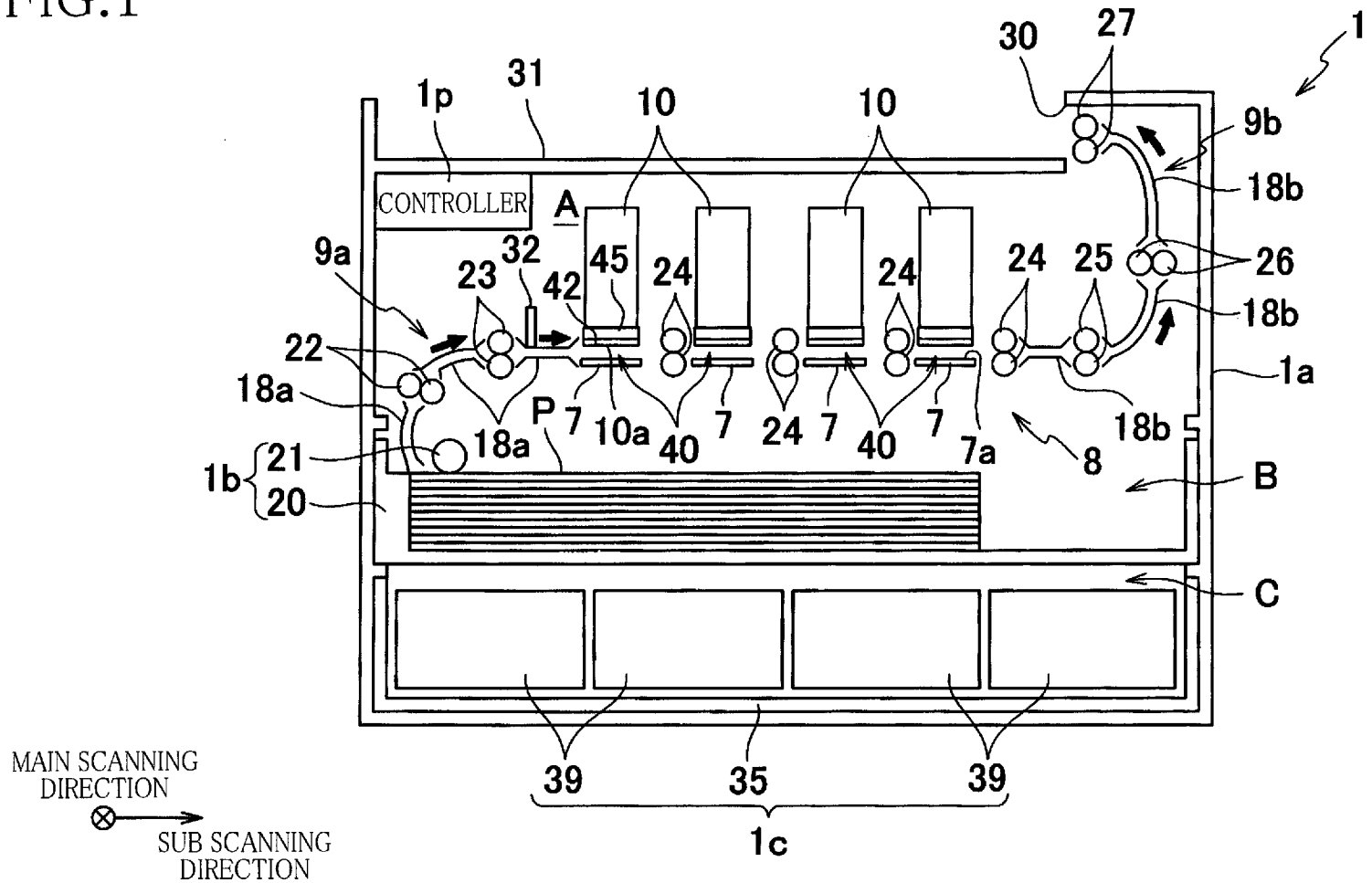
FIG. 1 is a schematic side view showing an internal structure of an ink-jet printer as a liquid ejecting apparatus according to one embodiment of the present invention.

Referring first to FIG. 1, there will be explained an overall structure of an ink-jet printer 1 as a liquid ejecting apparatus constructed according to one embodiment of the invention.

The printer 1 has a rectangular parallelepiped casing 1*a*. A discharge portion 31 is provided on a top plate of the casing 1*a*. An inner space of the casing 1*a* is divided into a space A, a space B, and a space C, arranged in this order from the top of the casing 1*a*. In the spaces A, B, a sheet conveyance path is formed so as to extend from a sheet supply unit 1*b* to the discharge portion 31. In the space A, image formation on a sheet P and conveyance of the sheet P to the discharge portion 31 are carried out. In the space B, supplying of the sheet P to the sheet conveyance path is carried out. In the space C, supplying of ink to heads 10 disposed in the space A is carried out.

In the space A, there are disposed a sheet sensor 32, four heads 10, a conveyor portion 8, two guide portions 9*a*, 9*b* for guiding the sheet P, capping mechanisms 40, a controller 1*p*, etc. The conveyor portion 8 includes four plate-like platens 7 (each as an opposing member) disposed so as to be opposed to the respective four heads 10 and four feed-roller pairs 24 disposed along the sheet conveyance path. The conveyor portion 8 is configured to convey the sheet P in a direction indicated by the bold arrows in FIG. 1, namely, in a sheet conveyance direction.

Each head 10 has a generally rectangular parallelepiped shape that is long in a main scanning direction. The four heads 10 are arranged in a sub scanning direction at a prescribed pitch and are supported by the casing 1*a* via a frame (not shown). The frame holds the heads 10 such that a prescribed clearance suitable for recording is formed between lower surfaces of the heads 10 and upper surfaces 7*a* of the platens 7. In each head 10, a plurality of ejection openings 14*a* (FIG. 6) for ejecting the ink are open to the lower surface of the head 10 (i.e., an ejection surface 10*a*).

The sheet sensor 32 is configured to detect a leading end of the sheet P that is being conveyed. Detection signals detected by the sheet sensor 32 are outputted to the controller 1*p*. In the controller 1*p*, ejection timing in image formation is set on the basis of the detection signals.

The two guide portions 9*a*, 9*b* are disposed such that the conveyor portion 8 is interposed therebetween. The guide portion 9*a* disposed on an upstream side in the sheet conveyance direction (hereinafter referred to as "the upstream-side guide portion 9*a*" where appropriate) includes three guides 18*a* and two feed-roller pairs 22, 23 and connects the sheet supply unit 1*b* and the conveyor portion 8. The sheet P on which an image is to be formed is conveyed toward the conveyor portion 8. The guide portion 9*b* disposed on a downstream side in the sheet conveyance direction (hereinafter referred to as "the downstream-side guide portion 9*b*" where appropriate) includes three guides 18*b* and three feed-roller pairs 25-27 and connects the conveyor portion 8 and the discharge portion 31. The sheet P on which an image has been formed is conveyed toward the discharge portion 31.

In the space B, the sheet supply unit 1*b* is disposed. The sheet supply unit 1*b* includes a sheet tray 20 and a sheet supply roller 21. The sheet tray 20 is removably attached to the casing 1*a*. The sheet tray 20 is a box opening upward and accommodates a plurality of sheets P. The sheet supply roller 21 is configured to supply an uppermost one of the sheets P in the sheet tray 20. Here, the sub scanning direction is a direction parallel to the sheet conveyance direction in which the sheet P is conveyed by the feed-roller pairs 23, 24 while the main scanning direction is a direction parallel to the horizontal plane and orthogonal to the sub scanning direction.

In the space C, a cartridge unit 1*c* is disposed so as to be attachable to and detachable from the casing 1*a*. The cartridge unit 1*c* includes a tray 35 and four cartridge 39 accommodated in the tray 35. In the four cartridges 39, inks of different colors, i.e., magenta, cyan, yellow, and black, are respectively stored. The cartridges 39 are connected to the corresponding heads 10 via respective tubes (not shown), so that the inks of different colors are supplied to the corresponding heads 10.

The controller 1*p* will be explained. The controller 1*p* is configured to control operations of various portions of the printer 1 so as to control overall operations of the printer 1. The controller 1*p* is configured to control an image forming operation on the basis of image data sent from an external device such as a personal computer (PC) connected to the printer 1. More specifically, the controller 1*p* is configured to control a preparatory operation relating to recording, operations of supplying, conveyance, and discharge of the sheet P, an ink ejecting operation in synchronism with the conveyance of the sheet P, etc.

The controller 1*p* drives a sheet supply motor (not shown) for the sheet supply roller 21*a*, feed motors (not shown) for the feed-roller pairs 22-27, etc., on the basis of a recording command received from the external device. The sheet P supplied from the sheet tray 20 is sent to the conveyor portion 8 by the upstream-side guide portion 9*a*. In the conveyor portion 8, the sheet P is conveyed while being supported on the upper surfaces 7*a* of the platens 7 in order. When the sheet P passes right below the heads 10 sequentially in the sub scanning direction (i.e., in the sheet conveyance direction), the inks of different colors are sequentially ejected from the respective heads 10 under the control of the controller 1*p*, so that a color image is formed on the sheet P. The sheet P on which the image has been formed is discharged to the discharge portion 31 through an opening 30 formed in the upper portion of the casing 1*a* by the downstream-side guide portion 9*b*.

Figure 7:
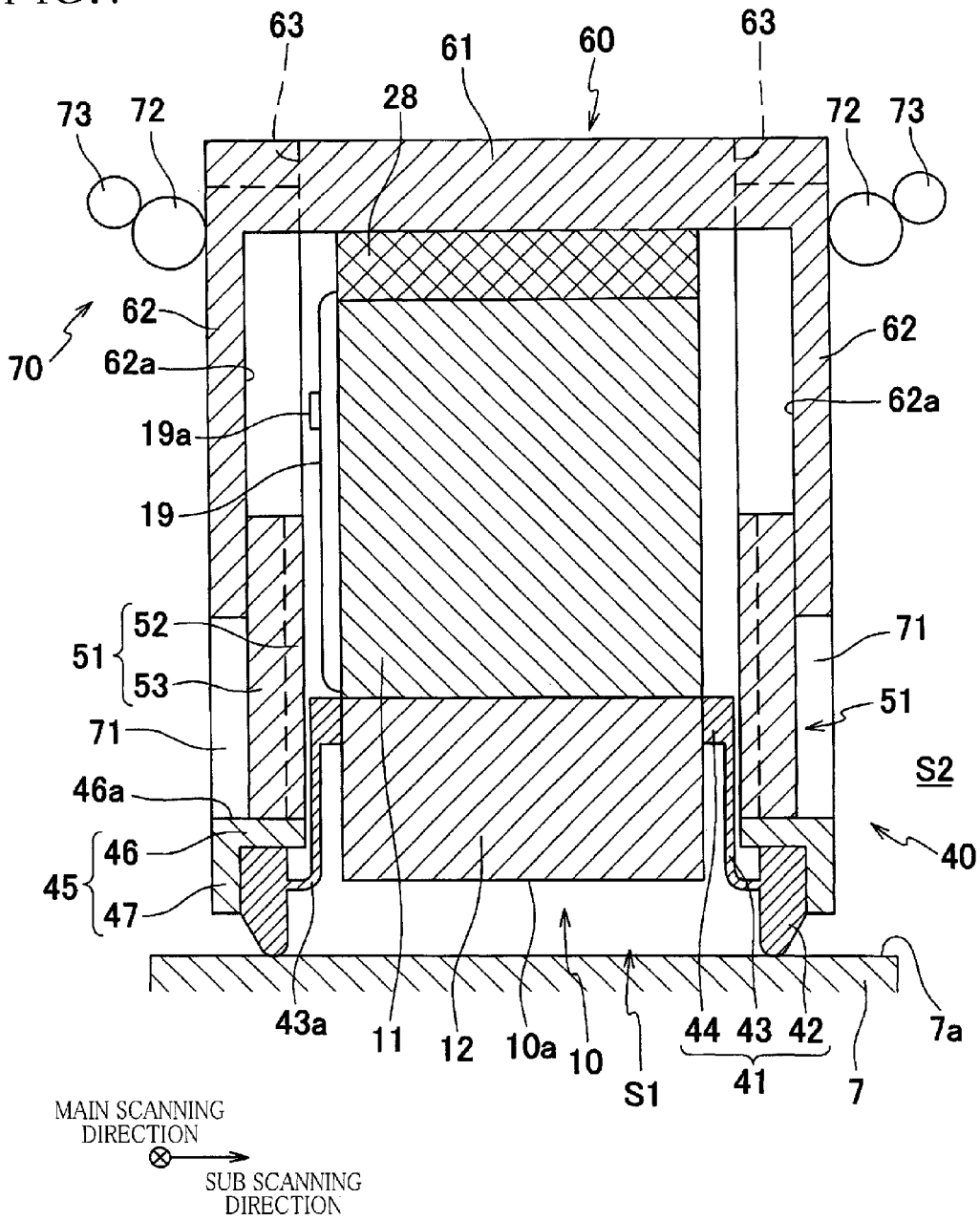
FIG. 7 is a view for explaining a hermetically sealed state established by the capping mechanism.

The controller 1p further controls a capping operation performed on the heads 10. In the capping operation in each head 10, an ejection space S1 is isolated from an external space S2 by a lip 42 of the capping mechanism 40, as shown in FIG. 7. It may be considered that the ejection space S1 is a space between the ejection openings 14*a* (the ejection surface 10*a*) of each head 10 and the upper surface 7*a* of the corresponding platen 7. The arrangement prevents the ink in the ejection openings 14*a* of the head 10 from drying. The capping operation is performed when the printer 1 is in a suspended state or a non-operating state. As will be later explained in detail, the capping mechanism 40 is selectively placed between: a hermetically sealed state in which the ejection space S1 is isolated from the external space S2; and a non-hermetically sealed state in which the ejection space S1 is open to the external space S2.

Figure 3A:
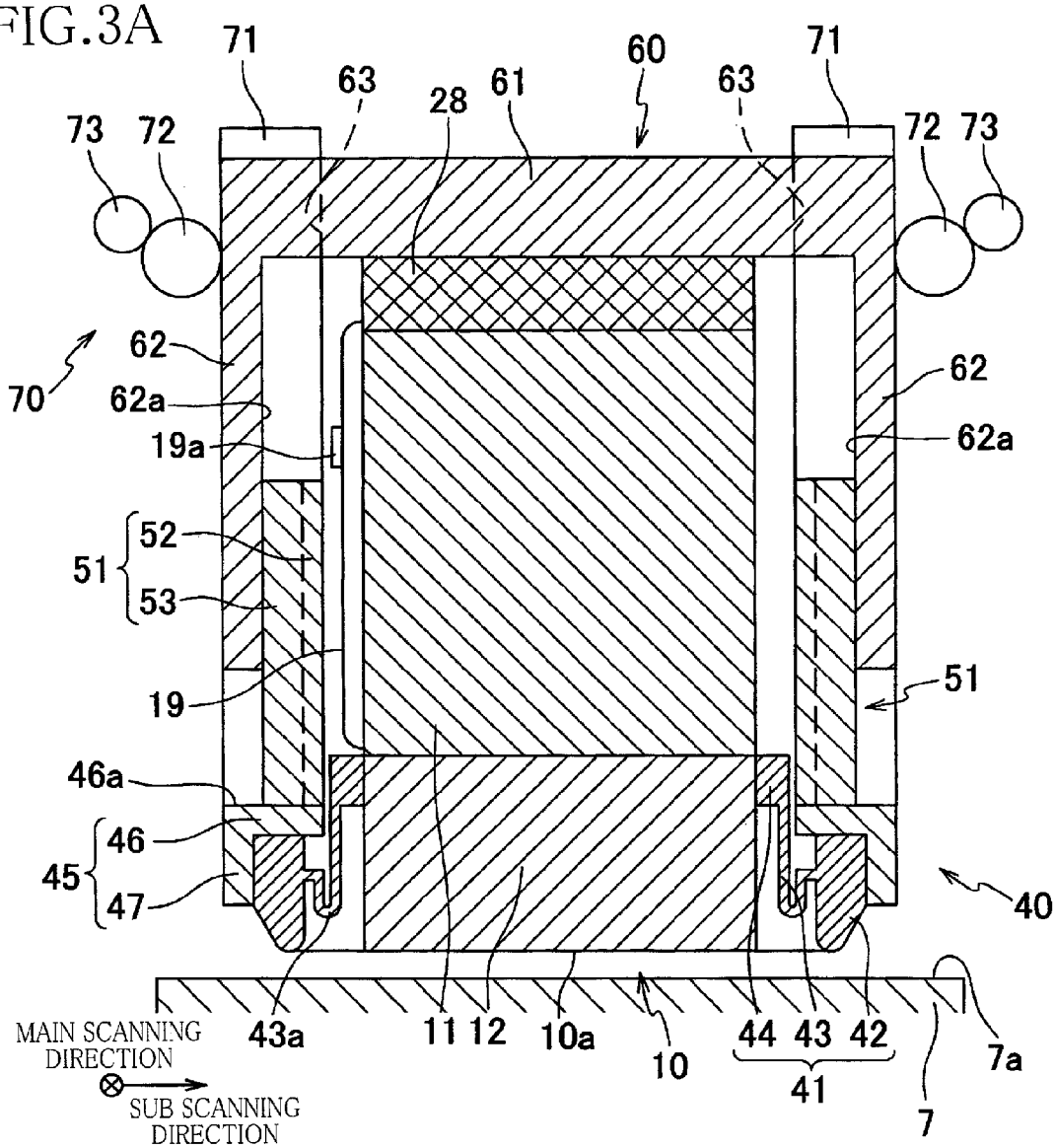
FIG. 3A is a cross-sectional view taken along line in FIG. 2
Figure 3B:
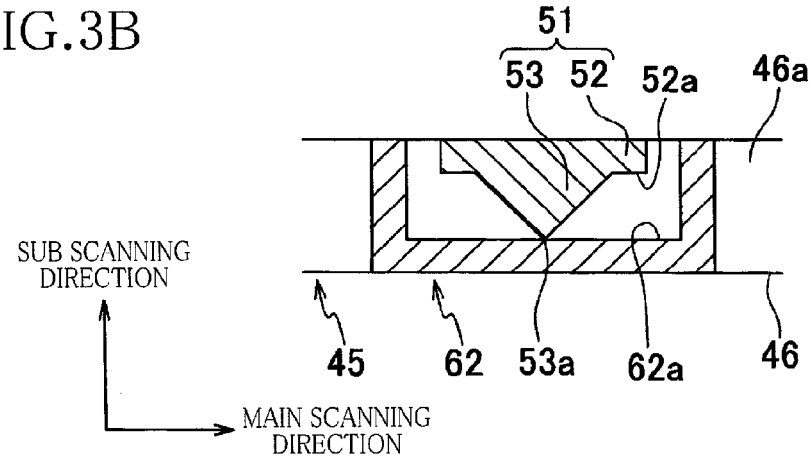
FIG. 3B is a cross-sectional view of a rod member and a guide.
Figure 4:
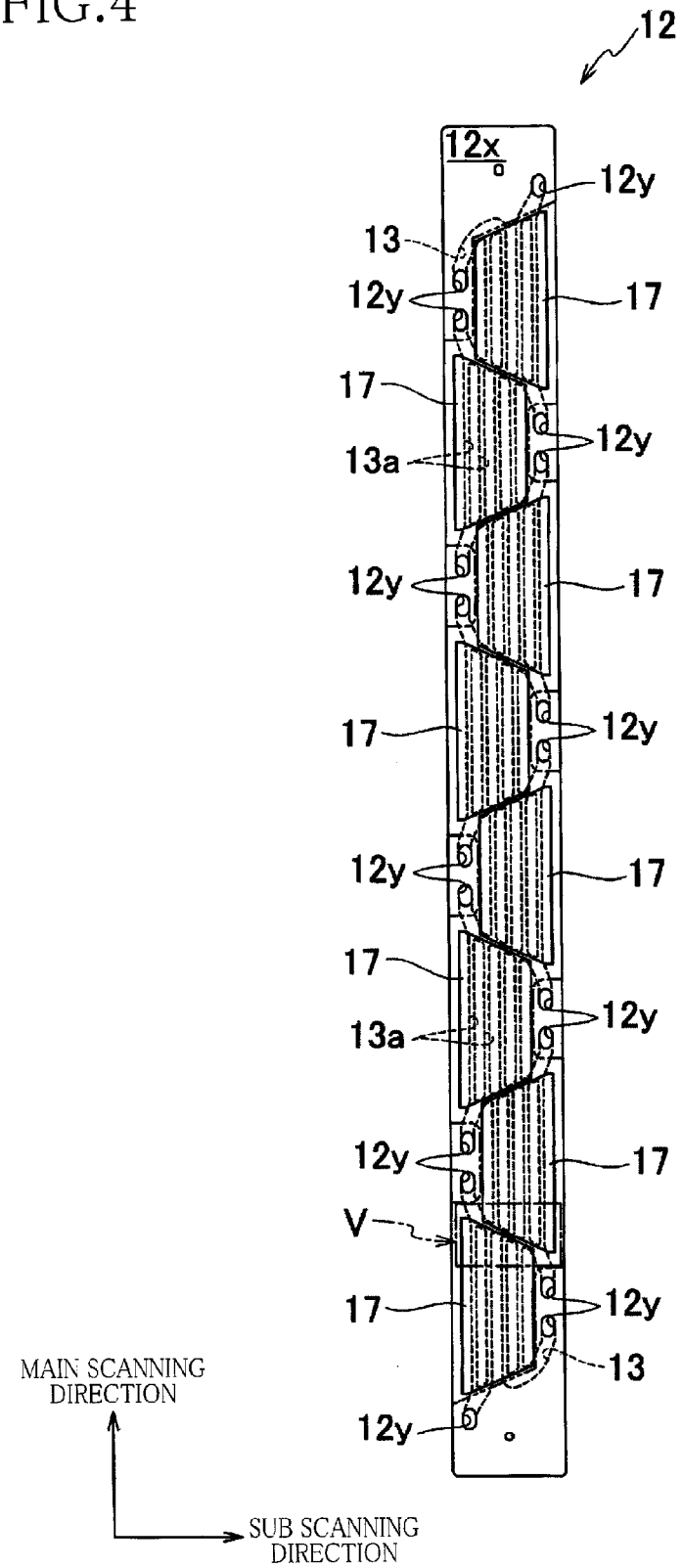
FIG. 4 is a plan view sowing a flow-passage unit and actuator units of the ink-jet head included in the printer of FIG. 1.
Figure 5:
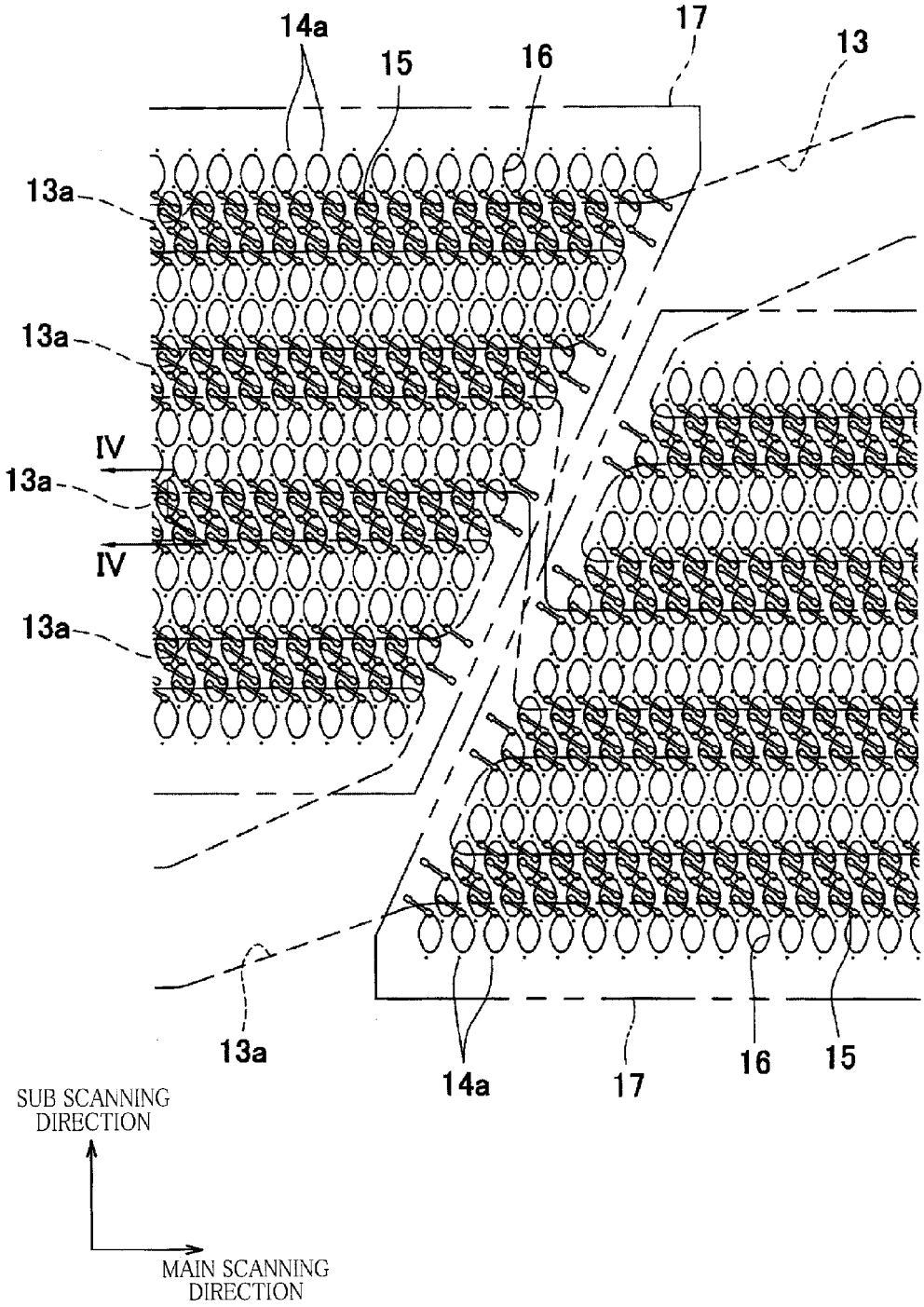
FIG. 5 is an enlarged view showing a region V enclosed with a long dashed short dashed line in FIG. 4.

Referring next to FIGS. 2-6, the structure of each head 10 will be explained. In FIG. 5, pressure chambers 16 and apertures 15 which are located under actuator units 17 and which should be illustrated by dashed line are illustrated by solid line.

As shown in FIGS. 2-6, each head 10 is a stacked body in which a flow-passage unit 12, the actuator units 17, a reservoir unit 11, a circuit board 28, and a head cover 60 are stacked in this order from the bottom of the head 10.

In the reservoir unit 11 as an upstream-side flow-passage forming member, upstream-side ink passages including a reservoir (both not shown) are formed, and the ink is supplied to the reservoir unit 11 from the cartridge 39. The reservoir temporarily stores the ink. On an upper surface of the reservoir unit 11, the head cover 60 as a stack member is stacked. The head cover 60 will be described in detail.

Figure 6:
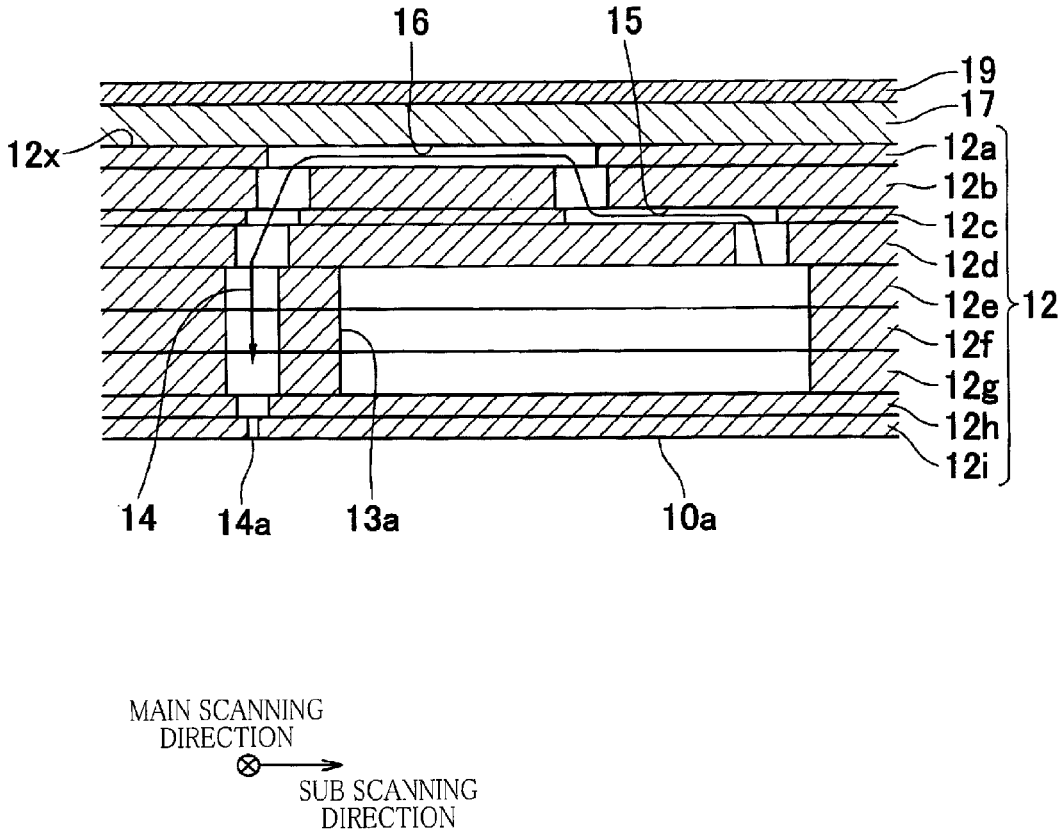
FIG. 6 is a partial cross-sectional view taken along line VI-VI in FIG. 5.

As shown in FIG. 6, the flow-passage unit 12 as a downstream-side flow-passage forming member is a stacked body in which nine rectangular metal plates 12*a*-12*i* are stacked. In the flow-passage unit 12, downstream-side ink passages are formed. As shown in FIG. 4, the downstream-side ink passages are connected to the upstream-side ink passages of the reservoir unit 11 at openings 12*y* of an upper surface 12*x* of the flow-passage unit 12. As shown in FIGS. 4-6, the downstream-side ink passages are constituted by manifolds 13 each having the opening 12*y* at one end thereof, sub manifolds 13*a* branched from the manifolds 13*a*, and a multiplicity of individual ink passages 14 connected to the sub manifolds 13*a*. Each individual ink passage 14 has the aperture 15 (orifice) for adjusting a resistance to the ink flow and extends from an outlet of the corresponding sub manifold 13*a* to the corresponding ejection openings 14*a* via the corresponding pressure chamber 16. The pressure chambers 16 are open to the upper surface 12*x* of the flow-passage unit 12 and are arranged in matrix. On the other hand, the ejection openings 14*a* are formed in the ejection surface 10*a* as the lower surface of the flow-passage unit 12 and are arranged in matrix so as to correspond to the pressure chambers 16.

The actuator units 17 are interposed between the reservoir unit 11 and the flow-passage unit 12, so as to be disposed in a staggered fashion along the main scanning direction. The actuator units 17 are fixed to the upper surface 12*x* of the flow-passage unit 12 and close openings of the pressure chambers 16. Each actuator unit 17 is a stacked body in which an uppermost piezoelectric layer polarized in the thickness direction is stacked on an oscillation plate. While the oscillation plate is also a piezoelectric layer, the oscillation plate does not spontaneously deform. The uppermost layer is interposed between a multiplicity of individual electrodes on the outer surface and an inner common electrode. When a portion interposed between one individual electrode and the common electrode deforms, the interposed portion and a portion of the oscillation plate corresponding to the interposed portion undergo unimorph deformation. The portions that undergo the unimorph deformation (between the individual electrode and the pressure chamber) act as an individual actuator and is selectively driven by a drive signal.

Each actuator unit 17 is electrically connected to one end of an FPC 19 as shown in FIGS. 3 and 6. The FPC 19 is electrically connected at another end thereof to the circuit board 28, so as to connect the actuator units 17 and the circuit board 28. On a portion of the FPC 19, a driver IC 19*a* is mounted. Under the control of the controller 1*p*, the FPC 19 transmits various signals, such as control signals and image signals, relayed and adjusted by the circuit board 28, to the driver IC 19*a*, and transmits the drive signals generated by the driver IC 19*a* to the individual actuators.

Figure 2:
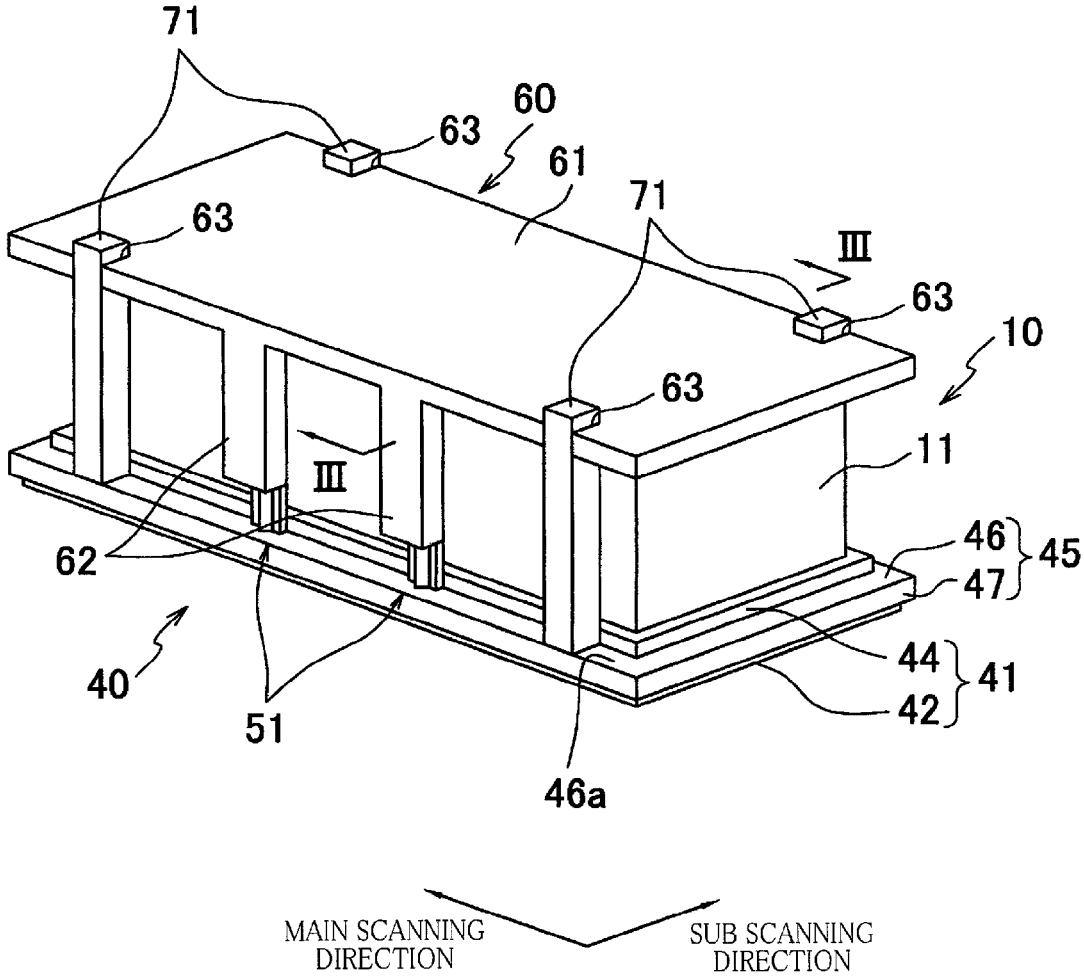
FIG. 2 is a schematic perspective view of an ink-jet head and a capping mechanism shown in FIG. 1;.

Referring next to FIGS. 2, 3, and 7, the structure of the capping mechanism 40 will be explained.

Each capping mechanism 40 includes a surrounding member 41, a holder 45, rod members 51, guides 62 of the head cover 60, and a moving mechanism 70. As shown in FIG. 3A, the surrounding member 41 includes the lip 42, a diaphragm 43, and an attaching portion 44 that are formed of an elastic material so as to be integral with each other. The lip 42 is formed to surround a periphery of the flow-passage unit 12 and has a cross-sectional shape that is tapered in the downward direction. Similarly, the attaching portion 44 is formed to surround the entire periphery of the flow-passage unit 12. As shown in FIG. 3, the attaching portion 44 is fixed to an upper end portion of an outer surface of the flow-passage unit 12.

The diaphragm 43 is formed to have a shape so as to surround the flow-passage unit 12 and is disposed between the lip 42 and the flow-passage unit 12. More specifically, the diaphragm 43 is a flexible, thin film member. An outer peripheral end of the diaphragm 43 is connected to an inner peripheral surface of the lip 42 while an inner peripheral end of the diaphragm 43 is connected to a lower surface of the attaching portion 44. The thus formed diaphragm 43 closes a space between the rip lip 42 and the flow-passage unit 12.

The lip 42 is located so as to be the most distant from the attaching portion 44 when the lip 42 is located at an abutting position at which the lip 42 is in abutting contact with the upper surface 7*a* of the platen 7. However, a linear distance between the outer peripheral end and the inner peripheral end of the diaphragm 43 is smaller than a length therebetween. Accordingly, the diaphragm 43 has a bent portion 43*a* between the lip 42 and the flow-passage unit 12, as shown in FIG. 7. In the present embodiment, irrespective of the position of the lip 42 with respect to the flow-passage unit 12, the bent portion 43*a* exists in the diaphragm 43. Since the bent portion 43*a* tends to expand, the lip 42 always undergoes a biasing force in an outward direction, namely, in a direction in which the lip 42 separates away from the head 10. According to the arrangement, even when the lip 42 is located at the abutting position, a pulling force by the diaphragm 43 to pull the flip 42 inward does not act on the lip 42. Therefore, it is possible to bring the lip 42 into abutting contact with the upper surface 7*a* of the platen 7.

As shown in FIG. 3A, the holder 45 has an L-letter shaped cross-sectional shape and is formed of synthetic resin. The holder 45 includes: a fixing portion 46 to which the upper end of the lip 42 is fixed and which has a shape surrounding the flow-passage unit 12; and a support portion 47 which extends downwardly from an outer peripheral end of the fixing portion 46. Each of the fixing portion 46 and the support portion 47 is a thin flat plate and has flexibility. An outer peripheral surface of the lip 42 is held in contact with an inner peripheral surface of the support portion 47 over the entire periphery of the lip 42. Since the holder 45 includes the support portion 47, it is possible to restrain outward deformation of the lip 42. In addition, since the support portion 47 is in contact with the lip 42 over the entire periphery of the lip 42, it is possible to restrain the outward deformation of the flip 42 more effectively. Like the heads 10, each of the surrounding member 41 and the holder 45 has a rectangular contour, in plan view, that is long in the main scanning direction.

At each of two longer-side portions of the fixing portion 46 which extend along the main scanning direction, two rod members 51 are provided so as to extend upright, as shown in FIG. 2. The two rod members 51 are disposed at a central region, in the main scanning direction, of an upper surface 46*a* of the fixing portion 46, namely, a middle region of each longer-side portion of the fixing portion 46 of the holder 45 when the longer-side portion is divided into three equal regions in the main scanning direction.

Each rod member 51 is constituted by a plate portion 52 and a protruding portion 53, as shown in FIG. 3. The plate portion 52 is a flat plate formed on the upper surface 46*a* of the fixing portion 46 so as to extend in the vertically upward direction. The protruding portion 53 is a protrusion formed on the plate portion 52 and is disposed on one side of the plate portion 52 remote from the reservoir unit 11. The protruding portion 53 is formed on a surface 52*a* of the plate portion 52 throughout the vertical direction. As shown in FIG. 3B, the protruding portion 53 has a triangular cross-sectional shape and is formed such that an apex 53*a* of the triangular shape is in contact with the guide 62. The guide 62 is dispose outwardly of the protruding portion 53.

The head cover 60 is constituted by a top plate portion 61 and the guides 62. The top plate portion 61 is a flat, rectangular plate in plan view and is fixed to the head 10 above the circuit board 28, so as to have a prescribed positional relationship relative to the head 10. The size of the top plate portion 61 in plan view is slightly larger than the head 10 and is substantially the same as the holder 45. Each of the four guides 62 extends in the vertically downward direction from a lower surface of the top plate portion 61. The guides 62 are provided so as to correspond to the respective rod members 51 and are disposed such that the reservoir unit 11 is sandwiched and interposed between the guides 62 in the sub scanning direction via the rod members 51. Since the top plate portion 61 and the guides 62 are integral with each other, the guides 62 have a prescribed positional relationship relative to the head 10. Accordingly, no variations are generated in the positional relationship between the head 10 and the guides 62. As shown in FIG. 3B, in the present embodiment, each guide 62 has a U-shaped cross-sectional shape in the horizontal direction, and the flat bottom surface of the U shape is a guide surface 62*a*. The apex 53*a* of the rod member 51 is kept in contact with the guide surface 62*a* of the corresponding guide 62.

Here, even if the holder 45 has low rigidity and the lip 42 tends to yield the biasing force from the diaphragm 43 and to thereby deform, the deformation of the lip 42 is restrained by the guide surface 62*a*. As shown in FIGS. 3 and 7, whichever position the lip 42 is located at between the abutting position (FIG. 7) and a separate position (FIG. 3) at which the lip 42 is separated away from the upper surface 7*a* of the platen 7, the guide 62 and the rod member 51 are in contact with each other in the sub scanning direction. Accordingly, the posture of the platen 7 with respect to the lip 42 is always constant, thereby ensuring good hermeticity at the abutting position.

In the present embodiment, the rod member 51 has the protruding portion 53 that is held in a line contact with the guide surface 62*a* along the vertical direction, thereby reducing a friction resistance between the rod member 51 and the guide 62. Accordingly, the holder 45 and the lip 42 can be smoothly moved by the moving mechanism 70 while being held in a sliding contact with each other. Therefore, the moving mechanism 70 is simplified in structure and is downsized. Further, the lip 42 and the upper surface 7*a* of the platen 7 move relative to each other in the vertical direction while the relative positional relationship therebetween is constant at any position, so that no clearance is formed between the lip 42 and the upper surface 7*a* when the lip 42 is located at the abutting position, for instance. Accordingly, the hermeticity in the hermetically sealed state is ensured, thereby suppressing thickening of the ink in the vicinity of the ejection openings 14*a*. As a modification, a protruding portion similar to the protruding portion 53 may be provided on the guide surface 62*a*, and the rod member 51 may be constituted only by the plate portion 52. In this instance, an apex of the protruding portion of the guide 62 and the surface 52*a* of the plate portion 52 of the rod member 51 are held in a line contact with each other along the vertical direction. Therefore, this modified arrangement offers advantages similar to those described above.

As shown in FIGS. 2 and 3, the moving mechanism 70 includes: four racks 71 formed on the upper surface 46*a* of the holder 45 so as to extend upright; four pinion gears 72 provided so as to correspond to the respective four racks 71; four drive gears 73 for transmitting rotational forces to the corresponding pinion gears 72; and four drive motors (not shown) for rotating the respective drive gears 73. Each pinion gear 72 meshes the corresponding rack 71 outside the rack 71. Like the rod members 51, two racks 71 are disposed at each of the two longer-side portions of the fixing portion 46 extending along the main scanning direction. The two racks 71 which are disposed at each longer-side portion of the fixing portion 46 of the holder 45 are located such that the two rod members 51 are interposed between the two racks 71, namely, the two racks 71 are located in one and the other of two opposite end regions of each longer-side portion of the fixing portion 46 when the longer-side portion is divided into three equal regions in the main scanning direction. The rack 71 extends from the upper surface 46*a* of the fixing portion 46 in the vertical direction, and its upper end is located at a height level higher than the head cover 60. In this arrangement, the rack 71 is disposed so as to pass through a corresponding one of cutouts 63 formed in the top plate portion 61. It is noted that the rack 71 functions also as an elevating and lowering guide for the holder 45 by passing through the cutout 63.

In the structure described above, when the drive motors for the drive gears 73 are driven under the control of the controller 1*p*, the gears 72, 73 are rotated, whereby the four racks 71 are elevated or lowered. In this instance, the holder 45 and the lip 42 are also elevated or lowered. In the present embodiment, the capping mechanisms 40 are provided for the respective heads 10. When one or more of the heads 10 are capped, the drive motors of a corresponding one or ones of capping mechanisms 40 are driven.

As described above, the lip 42 is selectively located at the abutting position and the separate position in conjunction with the elevating or lowering movement of the racks 71 and the holder 45. At the abutting position, the ejection space Si defined between the ejection surface 10*a* and the upper surface 7*a* of the platen 7 is hermetically sealed, so as to be isolated from the external space S2, as shown in FIG. 7. On the other hand, at the separate position, the ejection space S1 is not hermetically sealed, so as to be open to the external space S2.

Next, there will be explained control details of the capping operation executed by the controller 1*p*.

The controller 1*p* initially judges presence or absence of reception of a capping command. Before reception of the capping command, the lip 42 is located at the separate position. When the controller 1*p* receives the capping command, the controller 1*p* drives the drive motors for the drive gears 73 of each capping mechanism 40, whereby the distal end of the lip 42 is brought into contact with the upper surface 7*a* of the platen 7. As a result, the capping mechanism 40 is placed in the hermetically sealed state in which the ejection space S1 formed between the ejection surface 10*a* and the platen 7 is isolated from the external space S2.

In this instance, the upper portion of the rod member 51 and the upper portion of the guide 62 are kept in a line contact with each other, as shown in FIG. 7. Accordingly, even where the lip 42 and the holder 45 are outwardly biased by the diaphragm 43, namely, biased in a direction away from the head 10, the outward deformation of the holder 45 and the lip 42 is restrained by the guides 62 when the lip 42 is located at the abutting position, namely, when the capping mechanism 40 is in the hermetically sealed state. Therefore, the lip 42 can be brought into contact with the platen 7 at an appropriate position, ensuring the hermeticity in the hermetically sealed state.

In this way, the capping operation is completed. Sequentially when the controller 1p receives a signal, such as the recording command, from the external device, the controller 1*p* drives the drive motors for the drive gears 73 of each capping mechanism 40, whereby the distal end of the lip 42 is separated away from the platen 7. As a result, the ejection space S1 formed between the ejection surface 10*a* and the upper surface 7*a* of the platen 7 is open to the external space S2, thereby establishing the hermetically non-sealed state of the capping mechanism 40 shown in FIG. 3. Thereafter, the recording operation described above is carried out under the control of the controller 1*p*.

As explained above, in the printer 1 according to the present embodiment, even where the diaphragm 43 outwardly biases the lip 42, the outward deformation of the lip 42 and the holder 45 is restrained by the guides 62 when the lip 42 is located at the abutting position, namely, when the capping mechanism 40 is in the hermetically sealed state. Accordingly, the hermeticity in the hermetically sealed state is ensured, thereby suppressing thickening of the ink in the vicinity of the ejection openings 14*a*.

Further, whichever position the rip lip 42 is located at between the abutting position and the separate position, namely, whichever state the capping mechanism 40 is placed in between the hermetically sealed state and the hermetically non-sealed state, the guides 62 and the rod members 51 are in contact with each other, so that the outward deformation of the holder 45 and the lip 42 is restrained. Accordingly, the lip 42 can be brought into contact with the platen 7 at an appropriate position with high reliability.

The outward deformation of the holder 45 and the lip 42 is restrained by cooperation of the guides 62 and the rod members 51 disposed inside the corresponding guides 62, thereby simplifying the structure of the restraining member for restraining the outward deformation. As a modification, where the restraining member is disposed outwardly of the guide 62 in the biasing direction of the diaphragm 43, the restraining member may have a hook-like portion formed around the side of the guide 62 so as to be in contact with the guide surface 62*a* in the direction in which the diaphragm 43 biases the lip 42. In this modification, it is possible to restrain the outward deformation of the holder 45 and the lip 42.

Since the rod members 51 are disposed at the central region of the fixing portion 46 of the holder 45 in the main scanning direction, the outward deformation can be effectively restrained at respective central regions of the lip 42 and the holder 45 which are long in the main scanning direction. In each of the lip 42 and the holder 45, two shorter-side portions along the sub scanning direction are short, and it is accordingly possible to resist the biasing force of the diaphragm 43 owing to the rigidity of the holder 45 per se. Therefore, each of the holder 45 and the lip 42 is less likely to deform outwardly in the vicinity of end regions of each longer-side portion thereof. Accordingly, in each of the holder 45 and the lip 42, by restricting the outward deformation at the central region of each longer-side portion along the main scanning direction, the outward deformation of the lip 42 and the holder 45 as a whole can be restrained or prevented. As a modification, only one rod member 51 may be disposed at the central region of each longer-side portion of the fixing portion 46 of the holder 45. As another modification, three or more rod members 51 may be disposed at the central region of the upper surface 46*a*. These modifications assure advantages similar to those described above.

Figure 8:
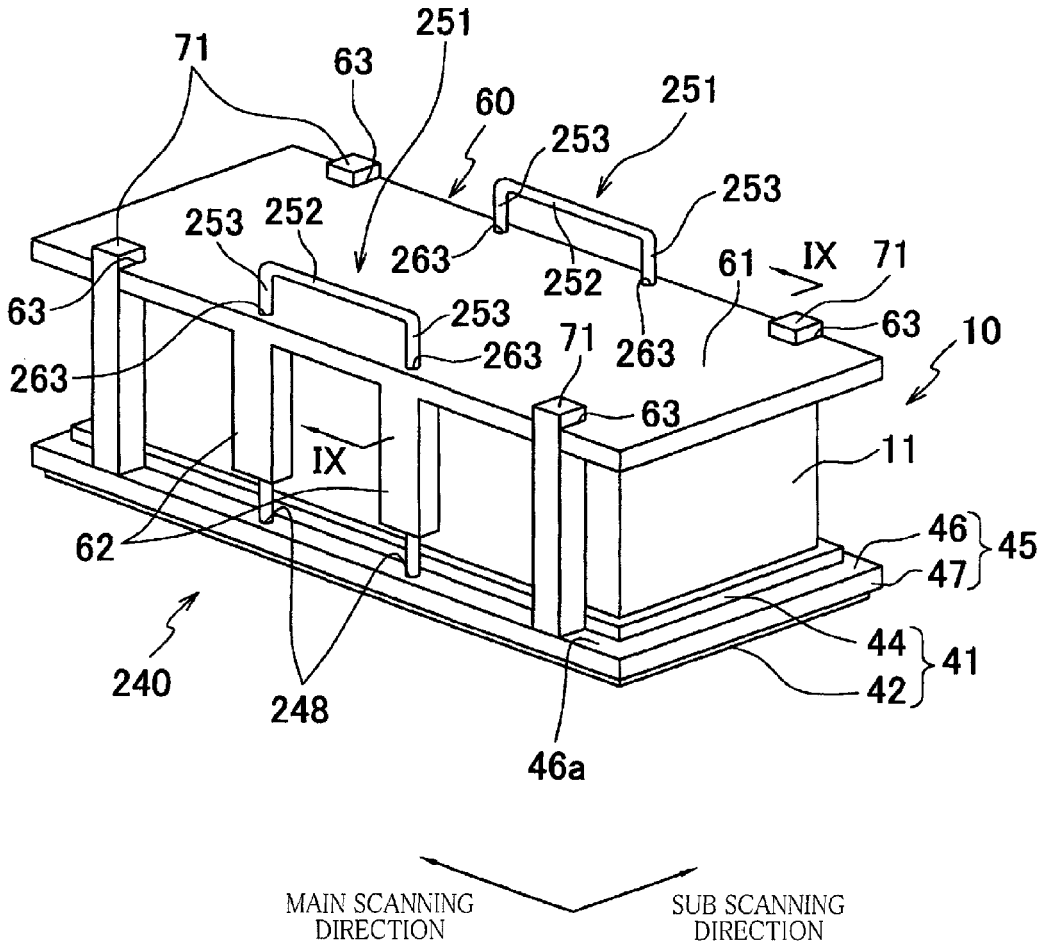
FIG. 8 is a schematic perspective view of an ink-jet head and a capping mechanism in a liquid ejecting apparatus according to a first modified embodiment of the invention.
Figure 9A:
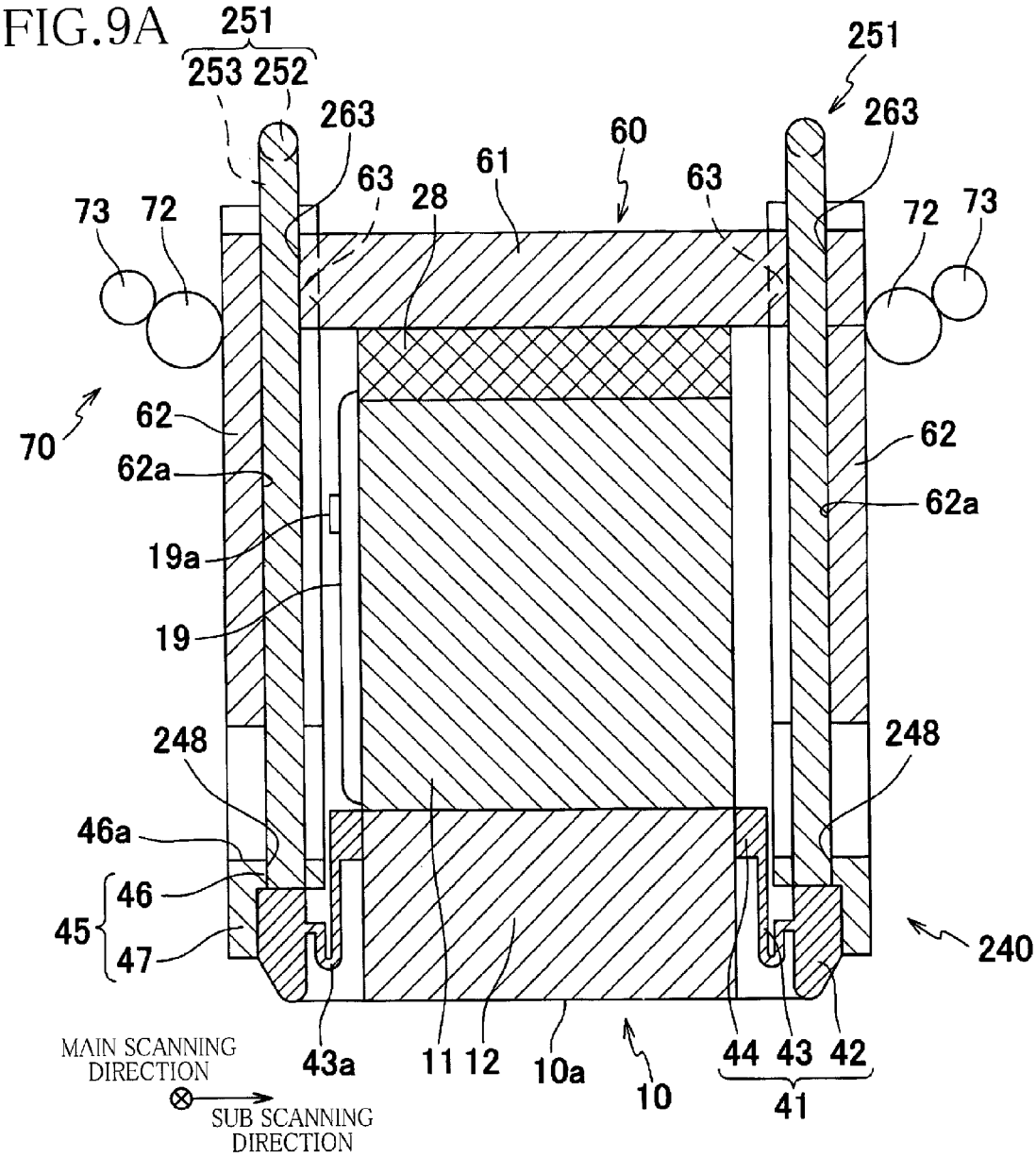
FIG. 9A is a cross-sectional view taken along line IX-IX in FIG. 8

Referring next to FIGS. 8 and 9, three will be explained a capping mechanism 240 according to a first modified embodiment of the invention. In the capping mechanism 240, two frames 251 are fixed to the holder 45, in place of the four rod members 51 in the capping mechanism 40 in the illustrated embodiment. Each frame 251 in this first modified embodiment is formed by bending a cylindrical metal rod into a U-letter shape. The frame 251 includes a horizontal portion 252 extending along the main scanning direction and two vertical portions 253 extending from one and the other of opposite ends of the horizontal portion 252 in the vertically downward direction. Four holes 263 are formed through the top plate portion 61 of the head cover 60 while four holes 248 are formed through the holder 45. Each of the holes 263 overlaps a corresponding one of the holes 248 in the vertical direction. The two vertical portions 253 of the frame 251 are inserted into the corresponding holes 263, and ends of the respective two vertical portions 253 of the frame 251 are fitted into the corresponding holes 248 so as to be fixed. In other words, the frame 251 is fixed to each of the two longer-side portions of the fixing portion 46 of the holder 45.

Figure 9B:
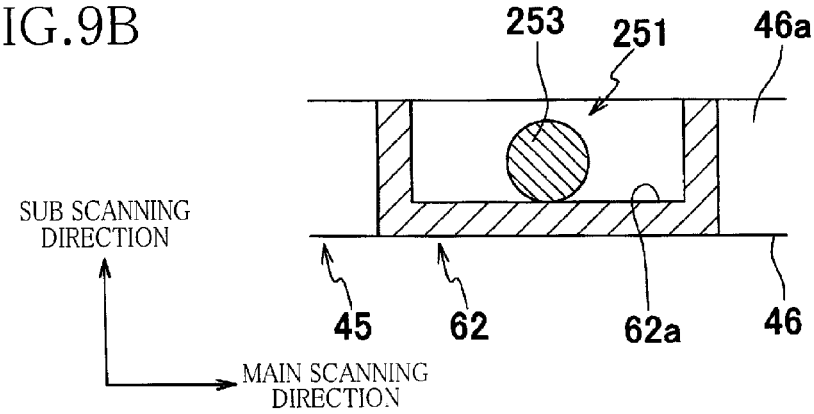
FIG. 9B is a cross-sectional view of a frame and the guide.

The vertical portions 253 of each frame 251 are disposed at the same positions as the rod members 51 as described above. That is, the two vertical portions 253 disposed along the main scanning direction at each of the two longer-side portions of the fixing portion 46 of the holder 45 are located at the central region of the upper surface 46*a* of the fixing portion 46. Further, each vertical portion 253 is opposed, inside the corresponding guide 62, to the guide 62 in the horizontal direction. Moreover, an outer circumferential surface of each vertical portion 253 is in contact with the guide surface 62*a* of the corresponding guide 62. As shown in FIG. 9B, the vertical portion 253 has a circular cross-sectional shape, so that the vertical portion 253 is held in a line contact with the guide surface 62*a* along the vertical direction. The arrangement reduces a frictional resistance between the frame 251 and the guides 62, ensuring advantages similar to those described above.

In the thus constructed capping mechanism 240, the vertical portions 253 of each frame 251 are disposed so as to extend from the holder 45 in the vertically upward direction through the head cover 60. Accordingly, the vertical portions 253 of each frame 251 are in contact with the corresponding guides 62, irrespective of whether the lip 42 is located at the abutting position or the separate position. As in the illustrated embodiment, even where the diaphragm 43 outwardly biases the lip 42 in a direction away from the head 10, the outward deformation of the holder 45 and the lip 42 is restricted by the frames 251 when the lip 42 is located at the abutting position. Therefore, the hermeticity in the hermetically sealed state of the capping mechanism 240 is ensured, thereby suppressing thickening of the ink in the vicinity of the ejection openings 14*a*. In this first modified embodiment, the structure similar to that in the illustrated embodiment offers advantages similar to those in the illustrated embodiment.

Figure 10A:
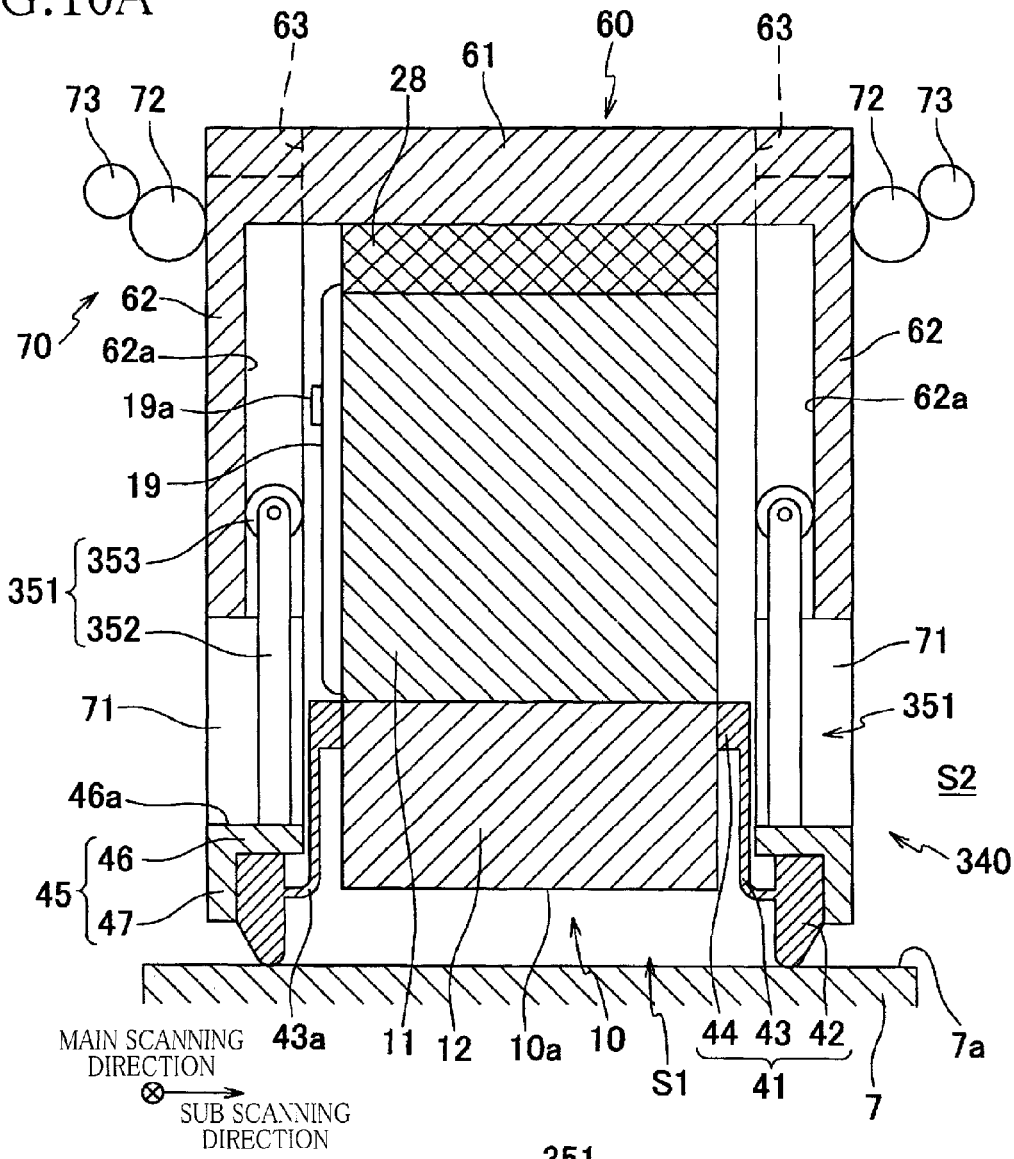
Figure 10B:
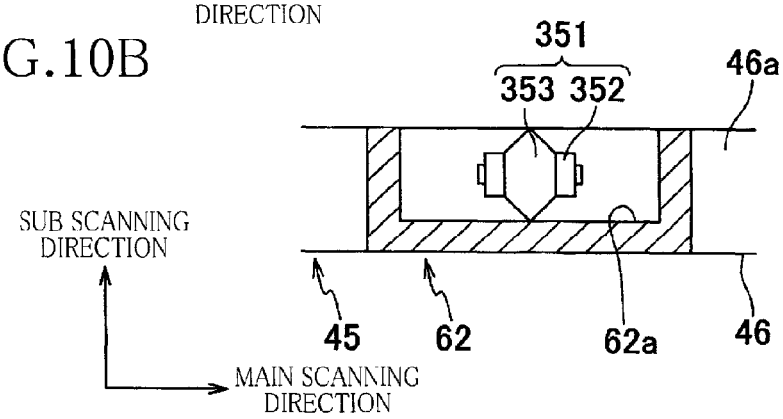

Referring next to FIG. 10, there will be explained a capping mechanism 340 according to a second modified embodiment of the invention. In the capping mechanism 340, roller members 351 are attached to the holder 45, in place of the rod members 51 in the capping mechanism 40 in the illustrated embodiment. As shown in FIG. 10, each of the roller members 351 in this second modified embodiment includes two support plates 352 extending from the upper surface 46*a* of the fixing portion 46 in the vertically outward direction and a roller 353 disposed between the two support plates 352. The roller 353 is rotatably supported by the support plates 352. The roller members 351 are disposed at respective positions of the holder 45 similar to those of the rod members 51 illustrated above. That is, the roller 353 has a shape in which two truncated cones are bonded to each other at bottoms thereof, and an outer circumference of the roller 353 is always in contact with the guide surface 62*a* of the corresponding guide 62. As shown in FIG. 10B, in the roller 353, a central portion, in the main scanning direction, of the outer circumference is tapered. Accordingly, the roller 353 and the guide 62 are held in a point contact with each other along the vertical direction, whereby a frictional resistance between the roller member 351 and the guide 62 is reduced, so as to ensure advantages similar to those described above.

In the thus constructed capping mechanism 340, the roller member 351 (the roller 353) is in contact with the corresponding guide 62 when the lip 42 is located at the abutting position, as shown in FIG. 10A. That is, as in the illustrated embodiment, in this second modified embodiment, each roller member 351 is in contact with the corresponding guide 62, irrespective of whether the lip 42 is located at the abutting position or the separate position. As in the illustrated embodiment, even where the diaphragm 43 outwardly biases the lip 42, the outward deformation of the holder 45 and the lip 42 is restricted by the guides 62 when the lip 42 is located at the abutting position. Accordingly, the hermeticity in the hermetically sealed state of the capping mechanism 340 is ensured, thereby suppressing thickening of the ink in the vicinity of the ejection openings 14*a*. In this second modified embodiment, the structure similar to that in the illustrated embodiment offers advantages similar to those in the illustrated embodiment.

In this second modified embodiment, the roller 353 of each roller member 351 is held in a substantial point contact with the corresponding guide surface 62*a* and the roller 353 rolls on the guide surface 62*a*. Accordingly, friction upon the movement of the roller 353 is smaller than in an arrangement in which the restraining member is held in a line contact with the guide surface 62*a*. In this instance, the roller 353 may be replaced with a cylindrical roller. The cylindrical roller may be configured to have a rotational axis along the main scanning direction and may be configured to be supported by support plates provided on the fixing portion 46, like the roller 353.

Figure 11A:
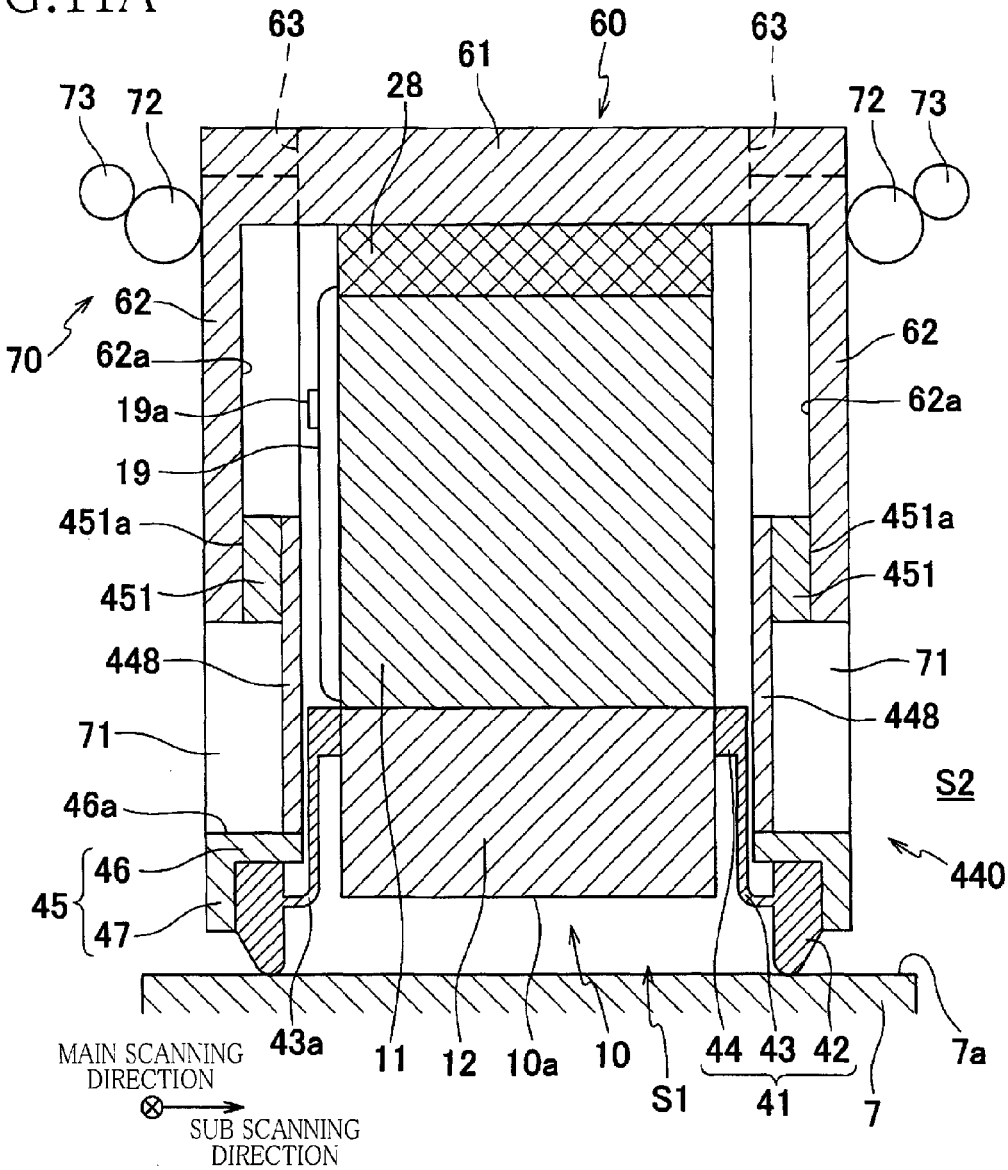
FIGS. 11A and 11B are views showing a liquid ejecting apparatus according to a third modified embodiment of the present invention, FIG. 11A being a view for explaining a hermetically sealed state established by a capping mechanism while FIG. 11B being a cross-sectional view of an extending portion, a restraining member, and the guide.
Figure 11B:
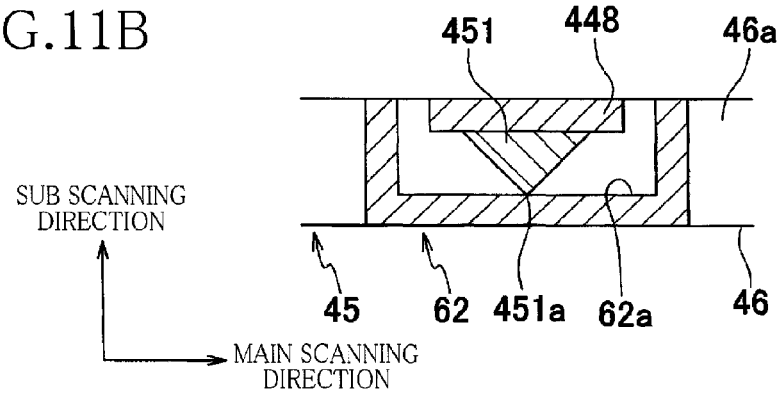

Referring next to FIG. 11, there will be explained a capping mechanism 440 according to a third modified embodiment of the present invention. The capping mechanism 440 includes, in place of the rod members 51, restraining members 451 each of which is disposed between a corresponding one of extending potions 448 provided on the holder 45 and a corresponding one of the guides 62. As shown in FIG. 11, each extending potion 448 is formed so as to be substantially similar to the plate portion 52 described above. Each restraining member 451 has a cross section similar to that of the protruding portion 53 described above and is formed only in a region of the extending potion 448 at which the extending portion 448 is opposed to the guide 62. That is, each restraining member 451 is disposed between the corresponding extending potion 448 and the corresponding guide 62, and an apex 451*a* of each restraining member 451 is always in contact with the guide surface 62*a* of the corresponding guide 62. Accordingly, the restraining member 451 and the guide 62 are held in a line contact with each other along the vertical direction, whereby a frictional resistance between the restraining member 451 and the guide 62 is reduced, so as to ensure advantages similar to those described above.

In the thus constructed capping mechanism 440, the restraining member 451 is in contact with the corresponding guide 62 when the lip 42 is located at the abutting position, as shown in FIG. 11A. That is, as in the illustrated embodiment, in this third modified embodiment, each restraining member 451 is in contact with the corresponding guide 62, irrespective of whether the lip 42 is located at the abutting position or the separate position. As in the illustrated embodiment, even where the diaphragm 43 outwardly biases the lip 42, the outward deformation of the holder 45 and the lip 42 is restricted by the guides 62 when the lip 42 is located at the abutting position. Accordingly, the hermeticity in the hermetically sealed state of the capping mechanism 440 is ensured, thereby suppressing thickening of the ink in the vicinity of the ejection openings 14*a*. In this third modified embodiment, the structure similar to that in the illustrated embodiment offers advantages similar to those in the illustrated embodiment.

In the third modified embodiment, each restraining member 451 is formed on the corresponding extending potion 448. Each restraining member 451 may be formed in a region of the corresponding guide 62 at which the guide 62 is opposed to the extending potion 448. In this instance, the apex 451*a* of the restraining member 451 is in contact with the corresponding extending potion 448, whereby advantages similar to those described above with respect to the third modified embodiment are obtained.

While the embodiments of the present invention have been illustrated above, it is to be understood that the invention is not limited to the details of the illustrated embodiments, but may be embodied with various other changes and modifications which occur to those skilled in the art without departing from the spirit of the invention defined in the attached claims. For instance, in the illustrated embodiment and the first and third modified embodiments, one of the guide 62 and the restraining member (such as the rod member 51) has the cross-sectional shape that enables a line contact of the guide 62 and the restraining member along the moving direction of the holder 45, namely, along the vertical direction. One of the guide 62 and the restraining member may have a cross-sectional shape that enables a surface contact with each other. Each guide 62 and each rod member 51 may not extend along the moving direction of the holder 45. Further, the guide 62 and the rod member 51 may be configured to be in contact with each other only when the lip 42 is located at the abutting position, namely, only when the cap mechanism is placed in the hermetically sealed state. These arrangements also offer advantages similar to those described above.

In the second modified embodiment, the support plates 352 provided on the fixing portion 46 function as support members for supporting the roller 353. Each guide 62 may function as the support member. In the arrangement shown in FIG. 10B, for instance, the two flat plate portions extending from the guide surface 62*a* of each guide 62 having the U-letter cross-sectional shape may function as the support members. The rotational shaft of the roller may be supported by the two flat plate portions, and the roller and the guide 62 (the guide surface 62*a*) may have a constant positional relationship. In this instance, the rod members 51 (the plate portions 52) each having a flat surface are formed on the fixing portion 46. The roller may be located so as to have a prescribed positional relationship with respect to the head, and the roller is in contact with the corresponding plate portion 52 in the movement in the vertical direction.

Where the position of the surrounding member 41 is fixed, the moving mechanism for moving the holder 45 and the guides 62 relative to each other may be configured such that the head 10 and the platen 7 are elevated and lowered, thereby selectively establishing the hermetically sealed state and the hermetically non-sealed state, and such that the guides 62 are elevated and lowered relative to the holder 45, thereby restraining the deformation of the holder 45 and the lip 42. The contour, in plan view, of each of the head 10, the surrounding member 41, and the holder 45 may not be long in one direction (i.e., the main scanning direction). The contour may be square, triangular, or circular. The support portion 47 may be in contact with only a part of the outer peripheral surface of the lip 42. The support portion 47 may not be formed in the holder 45.

The present invention is applicable to both of line-type printers and serial-type printers. The present invention is applicable to not only printers, but also facsimile machines, copying machines, etc. The present invention is applicable to liquid ejecting apparatus configured to carry out recording by ejecting a liquid other than ink. The recording medium is not limited to the sheet P, but may be various recordable media. The present invention is applicable irrespective of the kind of liquid ejection manner. For instance, while the piezoelectric elements are used in the embodiments, the liquid ejection manner may be a resistance heating manner or a capacitance manner.

What is claimed is:

1. A liquid ejecting apparatus, comprising:

a liquid ejecting head in which are formed ejection openings through which a liquid is ejected; and a capping mechanism configured to be selectively placed between: a hermetically sealed state in which an ejection space that is opposed to the ejection openings is isolated from an external space; and a non-hermetically sealed state in which the ejection space is open to the external space, wherein the capping mechanism includes:

a surrounding member having elasticity and integrally including (a) a lip which surrounds the liquid ejecting head and (b) a diaphragm which closes a space between the lip and the liquid ejecting head and which outwardly biases the lip;

a guide fixed to the liquid ejecting head so as to have a certain positional relationship with respect to the liquid ejecting head;

a holder which surrounds the liquid ejecting head and to which the lip is fixed;

a moving mechanism configured to move the guide and the holder relative to each other such that the capping mechanism is placed in one of: the hermetically sealed state in which the lip is located at an abutting position where the lip is in abutting contact with an opposing member opposed to the ejection openings with the ejection space interposed therebetween; and the non-hermetically sealed state in which the lip is located at a separate position where the lip is separated away from the opposing member; and a restraining member which is provided on one of the holder and the guide and which is configured to restrain outward deformation of the lip by contacting the other of the holder and the guide, when the capping mechanism is placed in the hermetically sealed state.

2. The liquid ejecting apparatus according to claim 1, wherein the holder is moved relative to the guide by the moving mechanism, wherein the guide extends in a moving direction of the holder in which the holder is moved, and wherein the restraining member is provided on the holder and is opposed to the guide in an orthogonal direction that is orthogonal to the moving direction, and wherein, whichever position the lip is located at between the abutting position and the separate position, the restraining member is in contact with the guide in the orthogonal direction.

3. The liquid ejecting apparatus according to claim 2, wherein the restraining member is a rod member extending in the moving direction, and wherein the guide is disposed outwardly of the rod member in a direction in which the diaphragm biases the lip.

4. The liquid ejecting apparatus according to claim 3, wherein at least one of the guide and the rod member has a cross-sectional shape that enables a line contact of the guide and the rod member along the moving direction.

5. The liquid ejecting apparatus according to claim 1, wherein the holder is moved relative to the guide by the moving mechanism, wherein the guide extends along a moving direction of the holder in which the holder is moved, wherein the holder includes an extending portion which extends along the moving direction and which is opposed to the guide in an orthogonal direction that is orthogonal to the moving direction, and wherein the restraining member is disposed between the extending portion and the guide and is provided on one of the extending portion and the guide, and wherein, whichever position the lip is located at between the abutting position and the separate position, the restraining member is in contact with the other of the extending portion and the guide in the orthogonal direction.

6. The liquid ejecting apparatus according to claim 5, wherein at least one of: the other of the extending portion and the guide; and the restraining member has a cross-sectional shape that enables a line contact of: the other of the extending portion and the guide; and the restraining member, along the moving direction.

7. The liquid ejecting apparatus according to claim 1, comprising a plurality of restraining members each as the restraining member, wherein each of the liquid ejecting head, the surrounding member, and the holder has a rectangular contour, in plan view, that is long in one direction, and wherein each of the plurality of restraining members is disposed at a central portion, in the one direction, of a corresponding one of two longer-side portions of the holder.

8. The liquid ejecting apparatus according to claim 1, wherein the holder includes a fixing portion to which an upper end of the lip is fixed and a support portion extending downwardly from the fixing portion so as to be held in contact with an outer peripheral surface of the lip.

9. The liquid ejecting apparatus according to claim 8, wherein the support portion is formed so as to be in contact with the outer peripheral surface of the lip over an entire periphery of the lip.

10. The liquid ejecting apparatus according to claim 1, wherein the liquid ejecting head includes: a flow-passage forming member in which are formed the ejection openings and flow passages communicating with the ejection openings; and a stack member which is stacked on one surface of the flow-passage forming member, and wherein the guide is formed integrally with the stack member.

* * * * *